United States Patent [19]

Lisnow

[11] 4,367,960

[45] Jan. 11, 1983

[54] WATCH CASE ASSEMBLY

[75] Inventor: Theodore E. Lisnow, Sands Point, N.Y.

[73] Assignee: Lisnow & Weiss Co, Inc., Long Island City, N.Y.

[21] Appl. No.: 249,239

[22] Filed: Mar. 30, 1981

[51] Int. Cl.[3] ..... G04B 37/00

[52] U.S. Cl. ..... 368/309

[58] Field of Search ..... 368/309, 276, 280, 285, 368/297, 298, 299, 300, 286, 287, 291, 292

[56] References Cited

U.S. PATENT DOCUMENTS

| | | | |
|---|---|---|---|
| 2,708,338 | 5/1955 | Pfisterer | 368/299 X |
| 2,749,702 | 6/1956 | Schwaibold | 368/299 |
| 3,690,062 | 9/1972 | Kasai et al. | 368/280 |
| 3,841,848 | 10/1974 | Kasai et al. | 368/280 X |
| 4,009,564 | 3/1977 | Zurcher | 368/309 X |
| 4,228,389 | 10/1980 | Vennard | 368/276 X |

*Primary Examiner*—J. V. Truhe
*Assistant Examiner*—T. Flower
*Attorney, Agent, or Firm*—Salter & Michaelson

[57] ABSTRACT

A watch case assembly having a main casing of substantially ring-like configuration, a stainless steel movement retaining ring attached within the bottom portion of the main casing, a gold rear wall retaining ring attached to the movement ring and a stainless steel rear wall attached to the rear wall ring. The rear wall ring extends outwardly from the movement ring abutting the maining casing and inwardly from said ring providing a surface for attaching the rear wall. When positioned on a wearer's wrist only the stainless steel rear wall engages the wearer's skin and only the main casing and the rear wall ring are visible and as a result the casing appears to be entirely gold.

7 Claims, 6 Drawing Figures

WATCH CASE ASSEMBLY

BACKGROUND OF THE INVENTION

The instant invention relates to watch case assemblies and the like which heretofore have been made from various metals such as gold, silver or stainless steel. Gold watch cases have always been among the most expensive cases available but despite their cost they have always been extremely popular as a result of their rich, attractive appearance. One of the unfortunate disadvantages, however, heretofore encountered with watch case assemblies constructed entirely of gold is that the back portion of the case can some times create an adverse reaction with the skin of the wearer. While this is not a problem for the majority of people, nonetheless there are a substantial number of people who cannot wear gold watches as a result of their extremely sensitive skin. A further disadvantage heretofore experienced with gold watch cases is that after a period of time the back portion of the case which contacts the wearer's skin can become pitted or corroded from perspiration, causing the gold to loose its rich attractive appearance. The instant invention effectively eliminates these and other disadvantages by providing a bi-metallic watch case assembly having a gold main casing and a stainless steel back portion. While it is not necessarily new to combine a stainless steel watch back with a gold or gold plated casing, the assembly of the instant invention effects this combination in a novel way wherein the stainless steel back of the watch is completely hidden from view when the watch is positioned on the wrist of a wearer. Previously known assemblies have generally effected the attachment of the stainless steel watch back by providing a back having a peripheral rim or ridge which is receivable in engagement within the side walls of the casing and as a result tends to raise the casing somewhat from the wrist of the wearer. The main disadvantage here is that the stainless steel back may be visible to an observer since it is not always concealed from view. While this may be of little significance with less expensive watches, it is of far greater importance with the more expensive gold watches. The assembly of the instant invention provides a novel and effective means for attaching a stainless steel back to a gold watch wherein the stainless steel insert portion is completely hidden from view when the watch is being worn.

In addition to providing an effective means of attaching a stainless steel back to a gold main casing, the assembly of the instant invention provides a novel means for positioning the movement portion of a watch within the main casing using a gold or stainless steel movement retaining ring. While it is not broadly new to position the movement portion of the watch within the main casing in this general manner, the movement retaining ring, disclosed in the instant invention effects a dual purpose by both positioning the movement within the main casing and also acting as a portion of the assembly used to secure the rear wall to the main casing.

SUMMARY OF THE INVENTION

The instant invention relates to watch case assemblies and the like and more particularly to a bi-metallic stainless steel and gold watch case assembly wherein the stainless steel back of the assembly is completely hidden from view when the watch is positioned on the wrist of a wearer. In the assembly of the instant invention a stainless steel back is attached to the gold main casing of a watch by means of a pair of retaining rings. A first ring (the movement retaining ring), which may be made of either stainless steel or gold, is disposed within the main casing of the watch in engagement with the rear inner surfaces of the walls thereof. A second ring, preferably made of gold, (the rear wall retaining ring) is disposed in engagement with the rear portion of the movement retaining ring extending outwardly therefrom and abutting the rear portion of the main casing. The rear wall ring also extends inwardly from the movement ring providing a surface for attaching the rear wall to the remainder of the assembly. As a result of the configuration of the rings and the back, it is possible to construct a watch case assembly wherein only the gold portions thereof are visible to an observer when the assembly is positioned on the wrist of a wearer. Accordingly, it is an object of the instant invention to provide an effective means of attaching a stainless steel back to the main portion of a gold watch case.

Another object of the instant invention is to provide a means for attaching a stainless steel back to the main portion of a watch case wherein the stainless steel back is completely concealed from view when the casing is positioned on the wrist of a wearer.

Another object of the instant invention is to provide a novel watch case assembly wherein the means for attaching the back to the main portion thereof also operates to effect the positioning of the movement portion of a watch therewithin.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
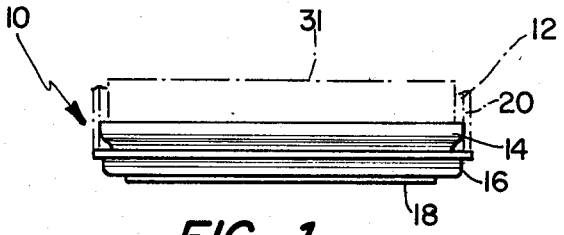
FIG. 1 is a side elevational view of the watch case assembly of the instant invention.
Figure 2:
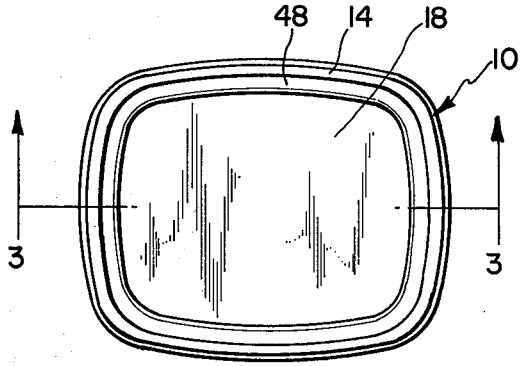
FIG. 2 is a top plan view thereof.

Referring now to the drawing, the watch case assembly of the instant invention is illustrated in FIGS. 1 through 4 and is generally indicated at 10. As will be noted, the assembly 10 comprises a main casing indicated at 12, a movement retaining ring indicated at 14, a rear wall retaining ring indicated at 16 and a rear wall indicated at 18.

Figure 3:
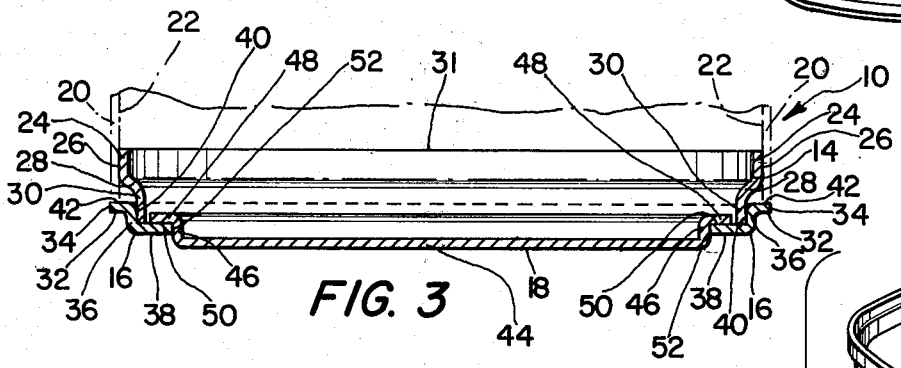
FIG. 3 is an enlarged side sectional view thereof taken along line 3—3 of FIG. 2.
Figure 4:
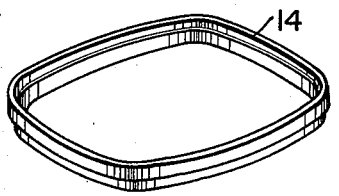
FIG. 4 is a bottom plan view thereof.
Figure 4:
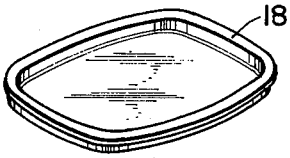
Figure 4:
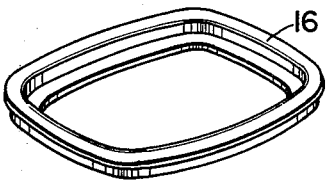
Figure 4:
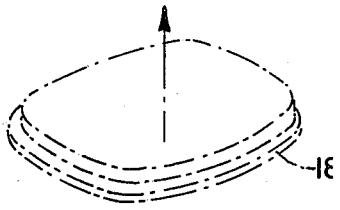

The main casing 12 is preferably made of gold or a gold alloy and as will be noted from FIGS. 1 and 3 is of substantially ring-like configuration with a peripheral wall 20 which defines an open center chamber 22 adapted to house the movement portion of a watch.

Figure 5:
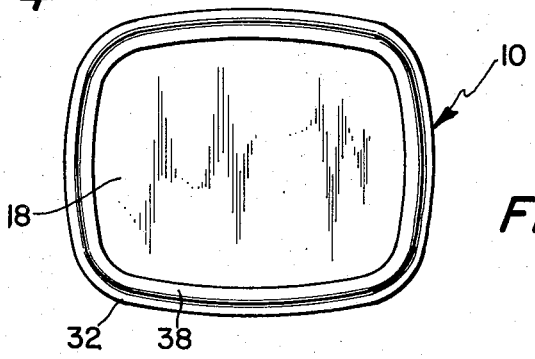
FIG. 5 is an exploded perspective view of the assembly.

The movement retaining ring 14 is most clearly illustrated in FIGS. 3 and 5. For economic reasons the ring 14 is preferably made of stainless steel, although it is understood that it could be made of any suitable material including gold and is formed in generally the configuration shown having an upper wall portion 24 which is dimensioned to be snuggly received within the bottom portion of the main casing 12 engaging the casing 12 as at 26 and being secured thereto with any suitable means such as solder or an epoxy or other suitable adhesive. As will be further noted from FIGS. 3 and 5, the ring 14 also includes a shoulder 28 which extends inwardly from the portion 24 and a lower wall portion 30 which extends downwardly from the portion 28. As will be noted, the shoulder 28 and the upper wall portion 24 cooperate to to effect the positioning of the movement portion 31 of a watch within the assembly 10.

The rear wall retaining ring 16 is also most clearly illustrated in FIGS. 3 and 5. The ring 16 is preferably made of gold or a gold alloy and includes an outwardly extending flange portion 32 having an outer edge 34. The ring 16 extends downwardly from the portion 32 with a neck portion 36 terminating in an inwardly extending flange portion 38. The ring 14 is dimensioned so that the wall portion 30 is snuggly received within the ring 16 with the outer surface of the wall portion 30 engaging in the inner surface of the neck portion 36 as at 40. The ring 16 is further dimensioned so that the portion 32 abuts the bottom end of the wall 20 as at 42 with the edge 34 being substantially flush with the outer surface of the wall 20 and in effect providing a slight downward extension thereof. The ring 16 may be secured to the ring 14 and to the wall 20 as required with any suitable means such as solder or an epoxy or other suitable adhesive and it is understood that the edge 34 and the outer surface of the wall 20 may be machined and polished to give the assembly a more unitary appearance if desired.

The rear wall 18, as will be noted particularly from FIG. 3, comprises a substantially flat plate 44 having an upwardly extending peripheral flange 46 which terminates in an outwardly extending flange 48. The rear wall 18 is preferably constructed of a corrosion resistant metal such as stainless steel and is dimensioned to fit within the ring 16 with the bottom surface of the portion 48 abutting the upper surface of the portion 38 as at 50 and with the terminal end of portion 38 abutting the outer surface of the flange portion 46 as at 52. Here again the rear wall 18 may be secured to the ring 16 with a suitable adhesive or solder.

Figure 6:
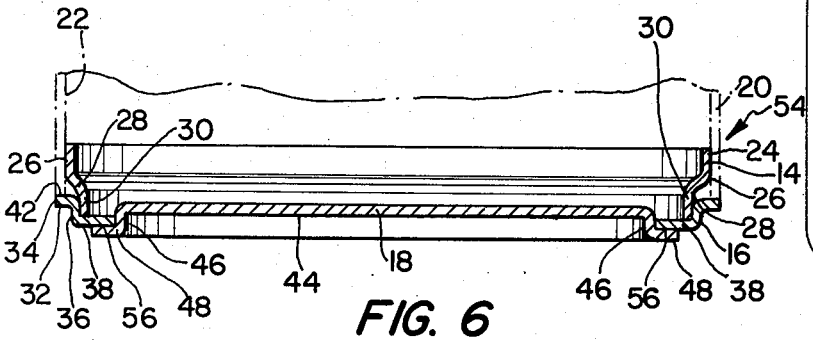
FIG. 6 is an enlarged side sectional view similar to FIG. 3 showing an alternative form of the assembly.

A further embodiment of the assembly of the instant invention is illustrated in FIG. 6 and is generally indicated at 54. As will be noted the only difference between the assembly 10 and the assembly 54 is that in the assembly 54 the rear wall 18 is inverted with the flange portion 48 abutting the bottom surface of the flange portion 38 as at 56. Here again the rear wall 18 may be secured to the flange portion 38 with any suitable adhesive or solder.

It is seen therefore that the assembly of the instant invention provides an effective means of attaching a stainless steel back of a watch case to the main portion thereof which may be of a precious metal such as gold. The ring 14 provides the means for securing the ring 16 and the rear wall 18 to the main casing 12 and also provides the means for positioning the movement portion of the watch within the casing 12. The ring 16 acts in effect as a rear extension of the casing 12 whereby the stainless steel rear wall 18 is virtually concealed from view when either of the assmblies 10 or 54 is positioned on the wrist of a wearer. Furthermore, while the stainless steel rear wall 18 is concealed from view it is nevertheless the only portion of either of these assemblies 54 or 10 which actually engages the wrist of the wearer.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A watch case assembly comprising:

a. a main casing of substantially ring-like configuration open at the bottom and having peripheral side walls which define an open center chamber;

b. a movement retaining ring snuggly received within said side walls adjacent the bottom end thereof;

c. a rear wall retaining ring attached to the bottom portion of said movement ring having an outwardly extending flange portion in engagement with the rear portion of said main casing and an inwardly extending flange portion which extends inwardly of said movement ring; and d. a rear wall attached to said inward flange portion extending across the open bottom of said assembly.

2. In the assembly of claim 1, said movement ring having an inwardly extending shoulder portion which receives the movement portion thereon.

3. In the assembly of claim 1, said rear wall having an offset peripheral flange portion, said inward flange portion being attached to said offset peripheral flange portion to effect the attachment of said rear wall to said rear wall ring.

4. In the assembly of claim 1, said main casing and said rear wall ring being gold.

5. In the assembly of claims 1 or 4, said rear wall being stainless steel.

6. In the assembly of claim 5, said movement ring being stainless steel.

7. A watch case assembly comprising:

a. a main casing of substantially ring-like configuration open at the bottom and having peripheral side walls which define an open center chamber;

b. a movement retaining ring having an upper wall portion which is snuggly received within said side walls adjacent to the bottom end thereof and secured thereto, a shoulder portion which extends inwardly from the bottom end of said upper wall portion and a lower wall portion which extends downwardly from said shoulder portion;

c. a rear wall retaining ring having a central neck portion, an outwardly extending upper flange portion and an inwardly extending lower flange portion, said lower wall portion being snuggly received by and secured to said neck portion, said upper flange portion engaging the rear portion of said main casing with the perimetric edge of said upper flange portion being substantially flush with the outer surfaces of said peripheral side walls;

d. a rear wall having an offset peripheral flange portion, which is attached to said lower flange portion, said rear wall extending across the open bottom of said assembly.

* * * * *